United States Patent [19]

Sciortino

[11] Patent Number: 4,655,403

[45] Date of Patent: Apr. 7, 1987

[54] ICE SHAVING MACHINE WITH STABILIZATION MEANS

[76] Inventor: Ronald R. Sciortino, P.O. Box 15589, New Orleans, La. 70175

[21] Appl. No.: 720,598

[22] Filed: Apr. 8, 1985

Related U.S. Application Data

[63] Continuation-in-part of Ser. No. 432,189, Nov. 8, 1982, abandoned.

[51] Int. Cl.[4] ..... B02C 19/12

[52] U.S. Cl. ..... 241/92; 241/278 R; 241/280; 241/285 R; 241/285 A; 241/DIG. 17

[58] Field of Search ..... 241/278 R, 280, 282, 241/DIG. 17, 281, 285 R, 296, 285 A, 92

[56] References Cited

U.S. PATENT DOCUMENTS

| | | | |
|---|---|---|---|
| 2,515,923 | 7/1950 | Hansen | 241/278 R X |
| 3,000,189 | 9/1961 | Bert | 241/DIG. 17 |
| 4,269,364 | 5/1981 | Moriconi et al. | 241/285 A X |
| 4,394,984 | 7/1983 | Hight et al. | 241/278 R |

FOREIGN PATENT DOCUMENTS

| | | | |
|---|---|---|---|
| 146457 | 11/1903 | Fed. Rep. of Germany | 241/DIG. 17 |

OTHER PUBLICATIONS

Machine drawings and five photographs of "Snow--Wizard" Snow Ball Machine by George Ortolano dated Apr. 14, 1948.

*Primary Examiner*—Howard N. Goldberg
*Assistant Examiner*—Joseph M. Gorski
*Attorney, Agent, or Firm*—Keaty & Keaty

[57] ABSTRACT

The invention relates to ice cutting machines, and specifically to the ice cutting machines for producing ice shavings for flavored confections such as snow cones and snowballs. The ice cutting machine of the present invention comprises an inner box and an outer box disposed in spaced relationship around the inner box. A plurality of continuous, parallel ice slides are provided on the interior of the bottom of the inner box, with each slide having an upwardly pointed tip. The slides are oriented perpendicularly to the cutting side of the inner box to provide a plurality of continuous surfaces upon which a block of ice is moved. A pusher plate within the ice cutting machine allows advancement of the block of ice towards a cutter. The bottom edge of the pusher plate has a plurality of bearings which fit in sliding relationship between adjacent slides to guide the pusher plate toward the cutter. The ice melts down into the grooves between adjacent ice slides to enhance stability of the ice, while minimizing the likelihood that ice will stick to the bottom of the ice cutting machine. Structure is provided to reduce vibrational movement of the block of ice, while it is being moved towards the cutter.

1 Claim, 12 Drawing Figures

130
176
186
128
178
174
184
172
170
126
154
146
148
142
122
124
174
136
138
128
126

ICE SHAVING MACHINE WITH STABILIZATION MEANS

CROSS-REFERENCE TO RELATED APPLICATIONS

This is a continuation-in-part of United States patent application Ser. No. 432,189 filed Nov. 8, 1982, now abandoned.

BACKGROUND OF THE INVENTION

1. Field of the Invention

This invention concerns ice shaving machines, in particular ice shaving machines suitable for producing ice shavings in flavored confections such as snow cones and snowballs.

2. General Discussion of the Background of the Invention

Much of the background of ice shaving machines, as well as details concerning the specific structure of the present invention, are disclosed in applicant's co-pending United States patent application Ser. No. 432,189 filed Nov. 8, 1982 for "Improved Ice Shaving Machine", the entire disclosure of which is incorporated by reference.

Ice shaving machines have been known for many years, as is illustrated by U.S. Pat. No. 2,515,923 issued to Hansen in 1950. That patent discloses a device in which a block of ice is advanced towards a cutting blade by a pusher plate while the block of ice is retained in place by a pressure plate on top of the block of ice. Several other machines have been produced over the years which are similar in design and function. All of them are intended to be used for the production of finely shaved ice which is suitable for consumption in the form of flavored snow cones or snowballs.

Many problems were inherent in the structure of these prior art machines. For example, the pressure plate was not sufficient to prevent movement of the block of ice as a rotating blade was cutting it. This freedom of movement permitted the block of ice to vibrate, thereby creating coarser ice shavings which were less desirable for consumption.

The pusher plate which was used to advance the block of ice towards the cutting element had similar drawbacks. These plates had sufficient freedom of movement to allow the block of ice to vibrate and adversely affect the consistency of the ice. Another drawback was that the movement of the pusher plate across the interior of the bottom of the ice shaving machine wore away the bottom of the plate and the bottom of the machine against which the plate moved.

Some early attempts were made to reduce the effects of wear on the bottom of the plate and ice shaving machine. For example, Hansen shows a plurality of flat, discontinuous ribs on which the block of ice was supported for sliding movement towards the cutter. The flat top surfaces of these ribs, however, resulted in ice sticking to them.

Yet another problem with prior art machines was their use of only a single boxlike member for housing the ice. Applicant has found, as is disclosed in his prior copending application, that a housing comprised of an inner box and an outer box provides greater insulation for the ice contained in the inner box. The provision of two boxes has created a problem, however, since it is difficult to suspend an outer box around an inner box without creating undue structural fatigue.

It is an object of the present invention to provide an ice shaving machine which minimizes vibrational movements of the block of ice and thereby increases the consistency of ice shaving size.

Yet another object of the invention is to provide a device that will not cause excessive wear between the bottom edge of the pusher plate and the bottom interior face of the inside box along which the block of ice slides.

Another object of the invention is to provide a means for minimizing movement of the pusher plate that advances the block of ice towards the cutter.

Yet another object of the invention is to provide a device having greater structural stability and ease of assembly.

SUMMARY OF THE INVENTION

The aforementioned objects are achieved by providing an ice cutting machine having an inner box and an outer box disposed in spaced relationship around the inner box. The inner box has a flat bottom, a top, a cutting side and pushing side. A plurality of continuous, parallel ice slides are provided on the interior of the flat bottom of the inner box, each ice slide having an upwardly pointed tip. The slides are oriented perpendicularly to the cutting side to provide a plurality of continuous surfaces upon which the block of ice is moved.

A pusher plate is provided within the box for advancing the ice towards a cutter on the cutting side of the device. The bottom edge of the pusher plate is provided with a plurality of bearings which fit in sliding relationship between adjacent slides to guide the pusher plate toward the cutter. In preferred embodiments the height of the bearings is greater than the height of the ice slides so that the bearings hold the bottom edge of the pusher plate in spaced relationship to the ice slides. These ice slides thereby guide the pusher plate and help retain it in parallel relationship to the flat cutting side of the box. The ice also melts down into the grooves between adjacent ice slides to further enhance the stability of the ice while minimizing the likelihood that the ice will stick to the bottom of the ice shaving device.

Vibrational movement of the block of ice is further decreased by providing a pressure mechanism in the interior of the inside box. The pressure mechanism is comprised of a pressure plate hingedly mounted in the interior of the inside box, the bottom face of the pressure plate being provided with a plurality of downwardly depending grating members which incline in the direction of the cutter. These grating members are similar to those seen in a cheese cutter, and they are arranged in a plurality of parallel rows to dig into the top of the block of ice across its width to help minimize movement of the block of ice adjacent the cutting blade. The pressure plate is elongated and is provided with downwardly inclined flanges along opposing longitudinal edges for further assisting in retaining the block of ice beneath the plate while permitting it to move towards the cutter.

The inner box is held in spaced relationship to the outer box, at least in part, by a pair of L-shaped flanges projecting outwardly from the front face of the inner box. A pair of opposing spacer members are also placed at the transverse ends of the box to conveniently hold the inner and outer boxes in spaced relationship to each other without creating undue structural fatigue. This arrangement also enhances ease of assembly.

DETAILED DESCRIPTION OF THE PREFERRED EMBODIMENT

Figure 1:
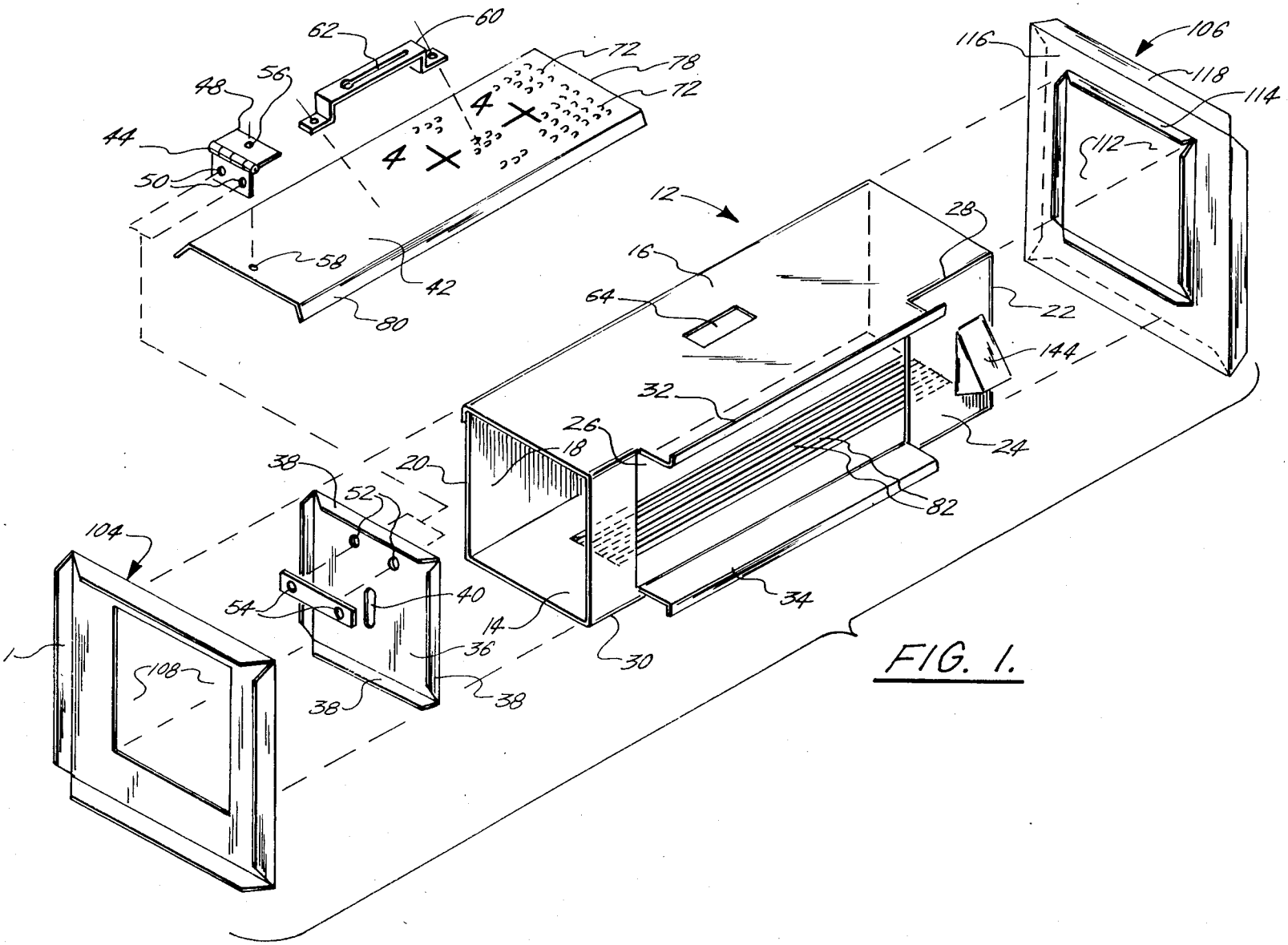
FIG. 1 is a perspective, exploded view of the inner box of the present invention.
Figure 2:
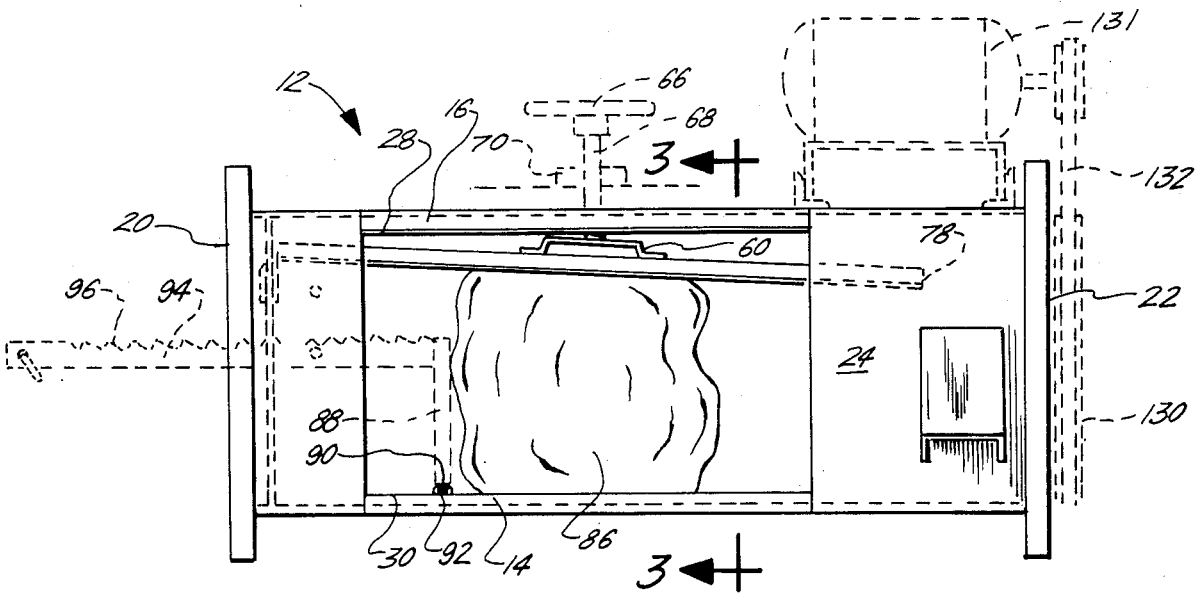
FIG. 2 is a front view of the assembled inner box.

The following detailed description of the preferred embodiment is being made in accordance with the requirements of law that a specific embodiment of the best mode of the invention be disclosed in sufficient detail to enable one skiled in the art to make and use the invention. This detailed description is not intended in any way to limit the scope of the invention which is more properly defined by the appended claims.

A device 10 (FIG. 5) for producing ice cuttings comprises an inner box 12 which is best shown in FIGS. 1–4. Inner box 12 is seen to be comprised of a flat rectangular base 14 held in spaced relationship to a flat rectangular top 16 by an upright rear wall 18. The inner box 12 has first and second flat, open opposing end walls 20, 22 adjacent the rear wall, and a front wall 24 parallel to back wall 18, front wall 24 being partially open and defining an ice receiving opening 26 having an upper edge 28 and a lower edge 30.

An L-shaped flange 32 projects outwardly from and upwardly over the upper edge 28 of ice receiving opening 26. An L-shaped flange 34 projects outwardly from and downwardly below lower edge 30 of ice receiving opening 26.

An inner plate 36 is configured to close first open end 20 of inner box 12, the inner plate 36 being comprised of a flat member having an area only slightly less than the cross-sectional area of open end 20. Perpendicular flanges 38 are provided on each edge of the flat member, flanges 38 fitting flat against the interior walls of inner box 12. Inner plate 36 defines an elongated slot 40 which is oriented vertically in plate 36.

A pressure mechanism is hingedly attached to inner plate 36, the pressure mechanism comprising an elongated, rectangular pressure plate 42 attached to inner plate 36 with a vertical hinge 44 adjacent a top edge of inner plate 36. Hinge 44 is comprised of a first flat member 46 and second flat member 48 which are held in hinged relationship to one another by vertical hinge 44. First member 46 is provided with a pair of holes 50 which correspond to holes 52 in plate 36. Fasteners 54 are placed through holes 52, 50 to hold hinge 44 flush against plate 36. Second member 48 is provided with a hole 56 which is positioned above hole 58 in pressure plate 42 so that a fastener (not shown) can be placed thorugh holes 56, 58 to secure the hinge to plate 42.

Plate 42 is provided with a means for moving plate 42 around the axis of vertical hinge 44. This means for moving plate 42 is seen in FIG. 1 to comprise a bracket 60 which is secured to plate 42 through holes provided therein specifically for that purpose. Bracket 60 contains an elongated slot 62 which is aligned with a rectangular opening 64 through the top 16 of inner box 12. A circular handle 66 having an externally threaded rod 68 (FIGS. 2, 3 and 5) is threaded through an internally threaded collar 70, the rod 68 terminating within bracket 60 and being secured within slot 62 for free rotational movement therewithin. Collar 70 is mounted on the exterior of an outer box to be described in greater detail below.

A plurality of grating members 72 depend downwardly from the bottom face of pressure plate 42 and incline in the direction of the cutter which is attached adjacent open end wall 22. Grating members 72 are of the kind conventionally seen in cheese graters, and are formed, for example, by punching out portions of pressure plate 42 to leave U-shaped openings 74 (FIG. 4) through plate 42. The edges 76 of grating members 72 are preferably sharp so that they can cut into a block of ice. In preferred embodiments grating members 72 are arranged in a plurality of parallel rows across the width of pressure plate 42 adjacent its leading edge 78. In the embodiment shown in FIG. 1, grating members 72 are arranged in parallel rows which extend from leading edge 78 along about one third of the length of pressure plate 42.

Pressure plate 42 is further provided with downwardly sloping flanges 80 along opposing longitudinal edges of the elongated plate for retaining a block of ice beneath the plate while permitting it to slide in the direction of elongation of the plate.

Figure 3:
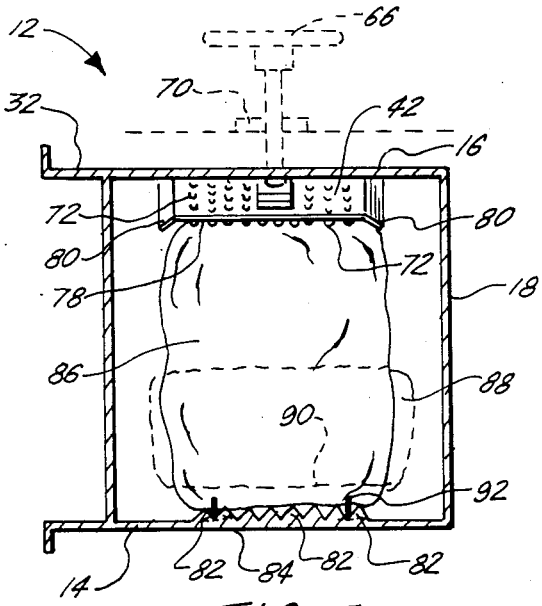
FIG. 3 is a cross-sectional view taken along section lines 3—3 of FIG. 2.
Figure 4:
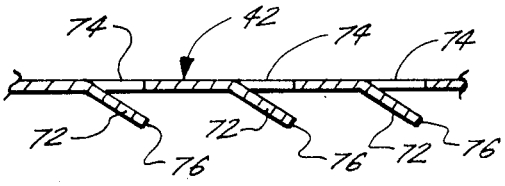
FIG. 4 is an enlaraged, cross-sectional view of the pressure plate which holds the ice in place.
Figure 4A:
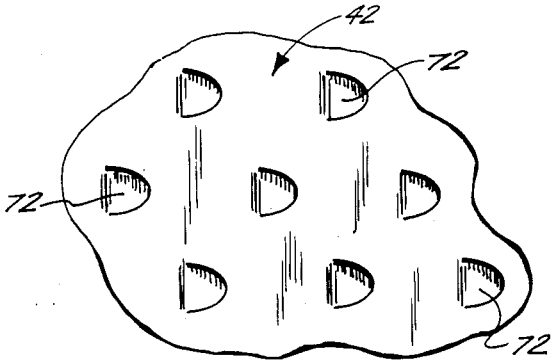
FIG. 4A is a top view of the grating shown in FIG. 4.

A plurality of continuous ice slides 82 are provided on the interior of flat base 14. As best seen in FIG. 3, the ice slides 82 have a triangular cross-section and terminate in an upwardly pointed tip 84. Ice slides 82 are substantially parallel to one another and are perpendicular to second end wall 22. Ice slides 82 provide a path along which a block of ice 86 slides towards the cutter mechanism in a manner to be described below. In preferred embodiments, slides 82 are form pressed into the bottom of inner box 12. In alternate embodiments they can be formed in a plate which is then secured to the bottom of the inner box 12.

A square pusher plate 88 is provided in parallel relationship to second end wall 22. A bottom edge 90 of pusher plate 88 is provided with a plurality of bearings 92 which fit in sliding relationship between adjacent ice slides 82 to guide pusher plate 88 towards end 22 while maintaining it in parallel relationship thereto. The height of bearings 92 is, in preferred embodiments, slightly greater than the height of ice slides 82 to hold bottom edge 90 of plate 88 in spaced relationship to ice slides 82. Bearings 92 can be in the nature of teflon blocks, rollers or spacers.

Figure 6:
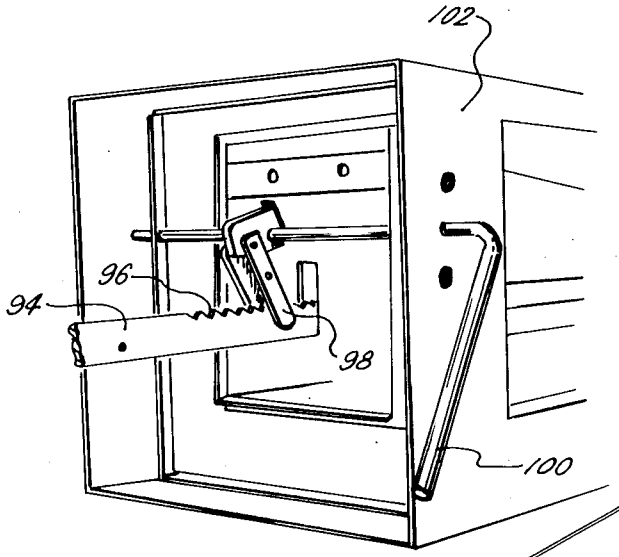
FIG. 6 is a perspective view of the pushing end of the device shown in FIG. 5, the details of construction of the pusher plate and attached arm being shown.

A pusher arm 94 is attached to one face of plate 88 and extends to the exterior of device 10 through slot 40 in inner plate 36. Arm 94 is provided with ratchets 96 along an upward edge. Ratchets 96 mate with a horizontal pin carried between parallel members 98 (FIG. 6) the pin carried by members 98 being advanceable towards the cutter by application of torque to handle 100 in a manner more fully described in applicant's co-pending application which is incorporated by reference. Once arm 94 has been advanced as far as possible by engagement with one ratchet, pressure is released on handle 100 and the pin is engaged with a ratchet closer to the end of arm 94. Torque is then applied to once again advance arm 94.

Figure 7:
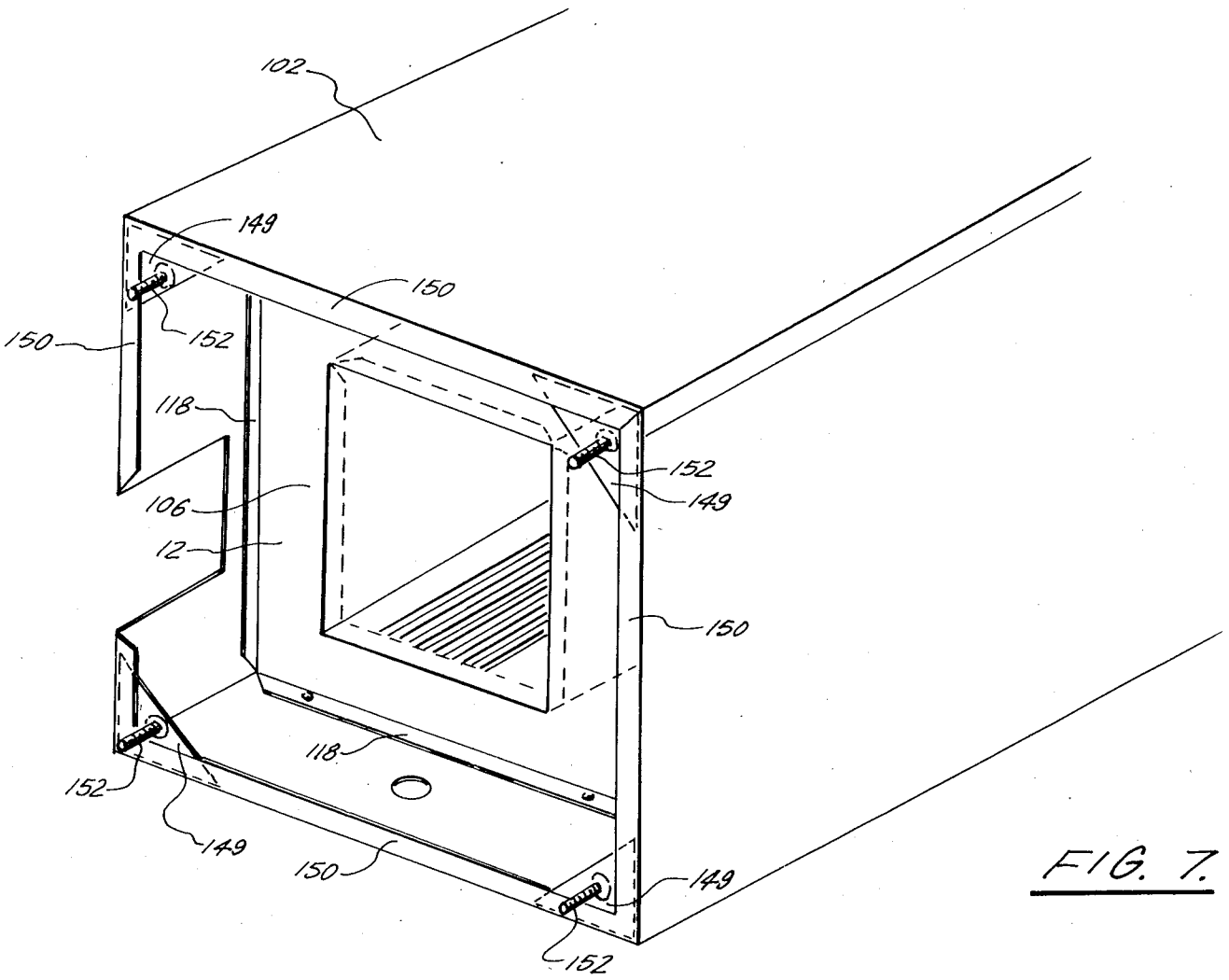
FIG. 7 is an end view of the cutting end of the device showing the structure for attachment between the outer box and cutter.

An outer box 102 (FIGS. 5-7) is held in spaced relationship around inner box 12 by first and second spacer members 104, 106 (FIG. 1). First spacer member 104 is comprised of a frame plate defining a square opening 108 and having a first set of flanges extending from a first face (not shown) which fit in contiguous relationship around open end 20 of inner box 12. Although the first set of flanges cannot be seen on spacer member 104 in FIG. 1, they will be understood to be identical to those shown on spacer member 106 described below. A second set of flanges 110 extend perpendicularly from a second face of spacer member 104 and fit in contiguous relationship with the interior of outer box 102. The second spacer member 106 is comprised of a frame plate defining a square opening 112 and having a first set of flanges 114 extending from a first face 116 of spacer member 106 which fit in contiguous relationship within the interior of open end 22 of inner box 12. A second set of perpendicular flanges 118 extend from a second face of spacer member 106 and fit in contiguous relationship with the interior of the outer box adjacent the cutting end. The flanges of spacer members 104, 106, are attached respectively to the inner box and outer box by spot welding.

Figure 5:
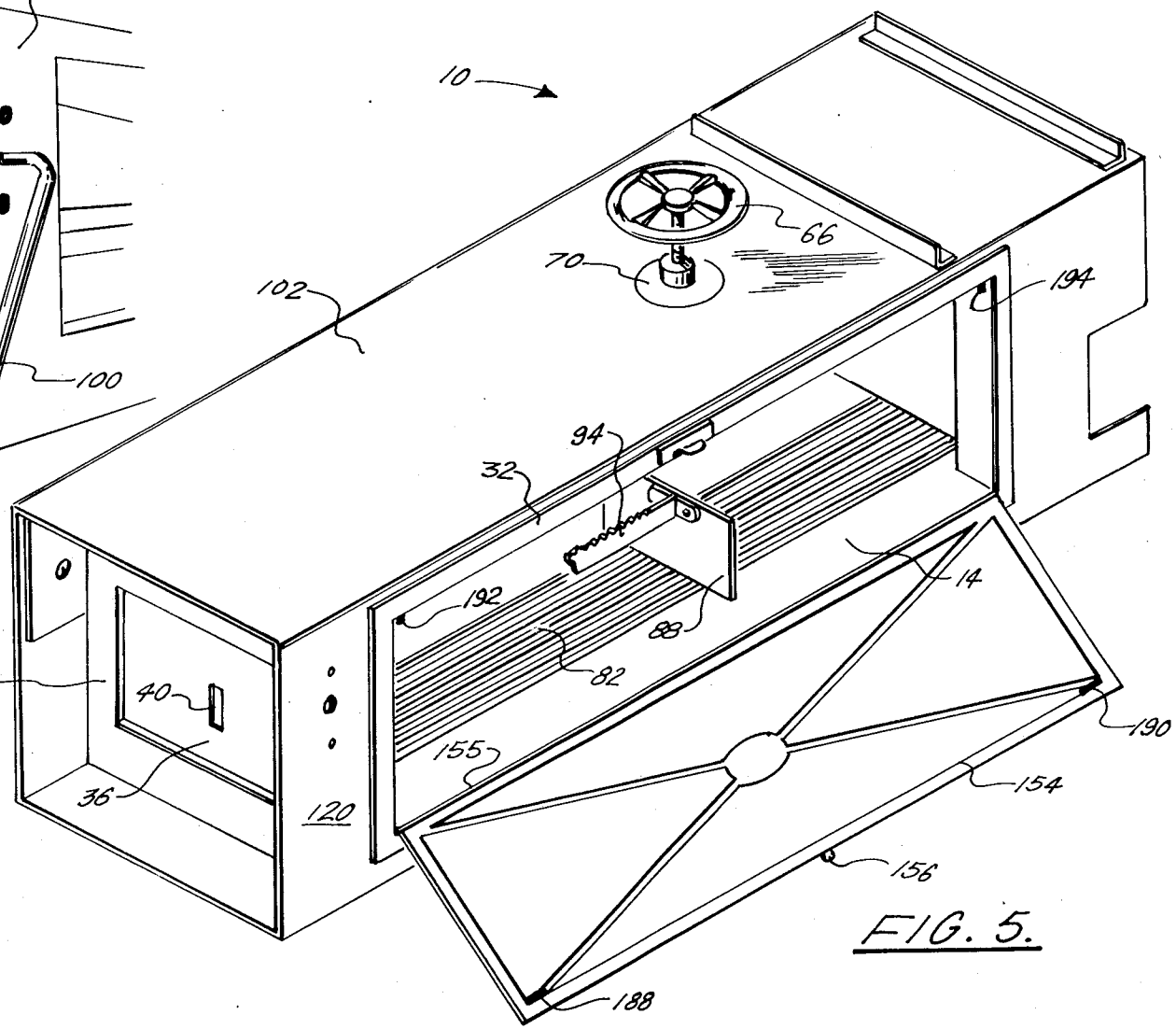
FIG. 5 is a perspective view of an assembled device showing the inner box inside of the outer box.

Outer box 102 is also held in spaced relationship to inner box 12 by the L-shaped flanges 32, 34 projecting outwardly from the top and bottom edges 28, 30 of ice receiving opening 26. As is best seen in FIG. 5, the inside lip of flanges 32, 34 is aligned against the outside front face 120 of outer box 102 and is, for example, spot welded in place.

Turning now to FIGS. 7-10, a cutter 122 is mounted adjacent second end wall 22 for cutting ice as pusher plate 88 advances ice 86 into cutter 122. The cutter is seen to be comprised of a cylindrical housing 124 which circumscribes a plate 126 affixed to an axle 128 which is attached at an opposite end to a drive wheel 130 that is driven by a belt 132 (FIG. 2) which is turned by motor 134. Plate 126 (FIGS. 8-9) is provided with radial slits 136 having sharp edged cutter blades 138 positioned therealong to cut ice coming into contact with plate 126. An integral, three-finned fan 140 is mounted to axle 128 and spins therewith to help propel ice shavings out of housing 124 through chute 142 and through exterior chute 144 into a paper cone placed beneath chute 144.

Housing 124 is mounted to end plate 146 by fasteners secured through openings 148 in plate 146. Plate 146 is in turn secured to triangular braces 149 (FIG. 7) which are welded in the corners formed between inwardly turned flanges 150 of second end 22 and the walls of outside box 102. Screws 152 are placed through openings in braces 149 with the heads of the screws facing the interior of outer box 102. Plate 146 is secured to outer box 102 by means of screws 152 being placed through holes 154 and fastened in place with nuts. Any pushing forces exerted on plate 146 are thereby transmitted to the inwardly turned flanges 150 to provide an inherently stable structure as ice pushes against cutter 122.

Figures 8, 9, 11:
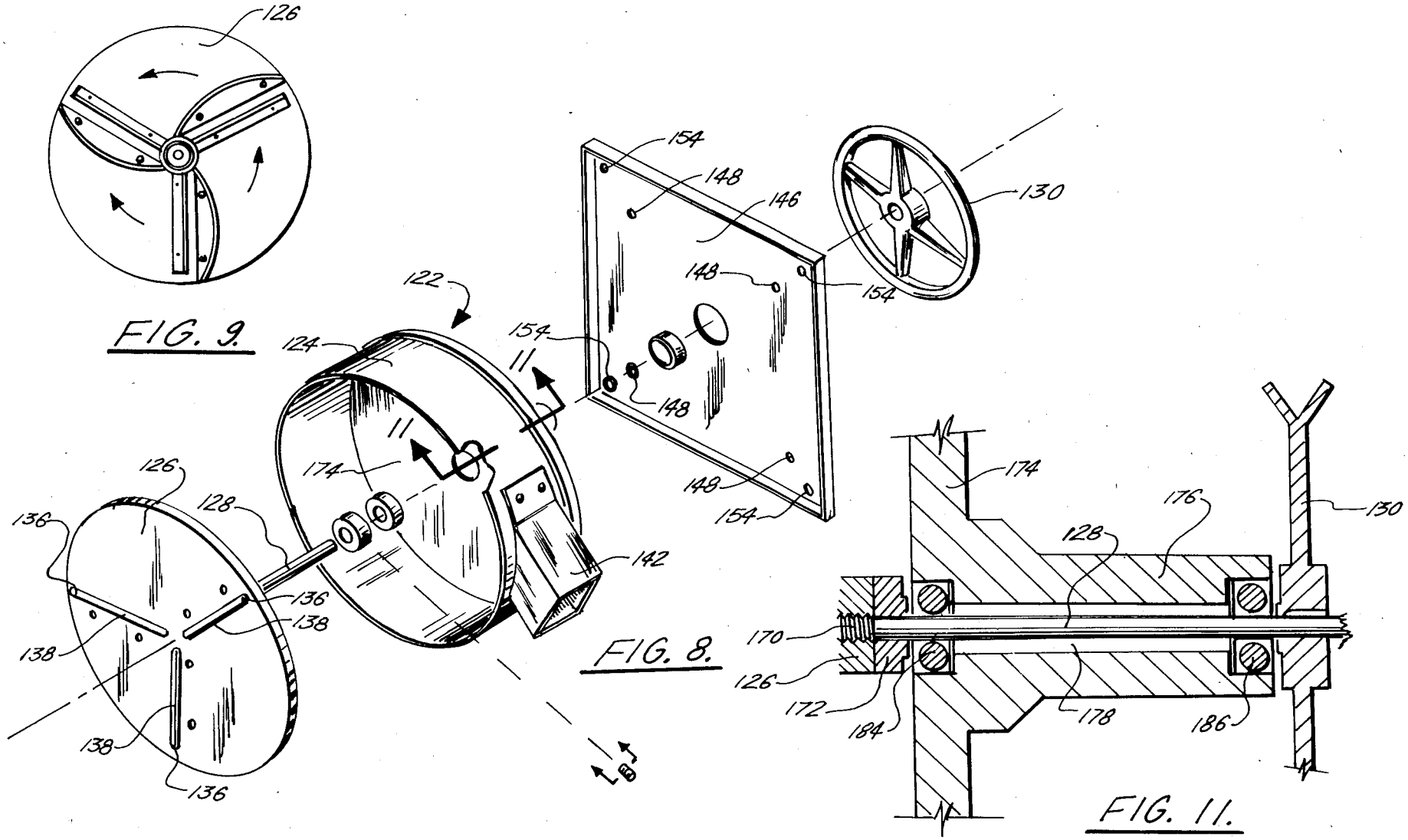
FIG. 8 is an exploded view of the cutter which is mounted on the cutting end of the device.
FIG. 9 is an isolated plan view of the cutting plate shown in FIG. 8.
FIG. 11 is a view along section lines 11—11 of FIG. 8, showing the double sealed bearings which support the shaft that turns on the plate on which the blades are mounted.
Figure 10:
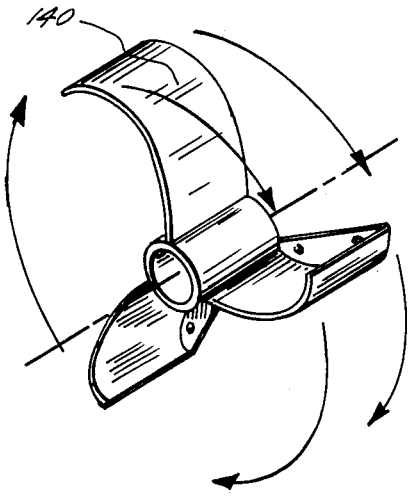
FIG. 10 is a perspective view of a fin which is fixed to the spinning shaft inside the cutter for propelling shavings out a chute.

FIG. 11 shows an improved double sealed bearing which maintains the plate 126 in a single plate of rotation and decreases or eliminates wear on the rotating axle 128 and surrounding structure. Plate 126 is provided with an internally threaded aperture that mates with external threads 170 on the tip of axle 128. A flat fact collar 172 circumscribes axle 128 between plate 126 and the circular face 174 of housing 124 to provide a solid, flat surface against which plate 126 rests, thereby helping assure rotation of plate 126 in a single plane. A projection 176 projects outwardly from face 174 and defines a cylindrical passageway 178 which circumscribes axle 128. Enlarged diameter portions 180, 182 of passageway 178 contain sealed bearings 184, 186, which are comprised of greased bearings carried between seals. Drive wheel 130 is fixed to an end of axle 128 that protrudes from projection 176.

The double sealed bearings prevent axle 128 from wearing against the surrounding projection 178 by stabilizing axle 128 and maintaining its rotation about a single axis. These bearings also assure that axle 128 is truly straight when it is inserted through passageway 178.

In operation, door 154 is opened and pusher plate 88 is retracted to a position adjacent first end 20 of inner box 12. A rectangular block of ice is then placed inside inner box 12 through opening 26, and door 154 is shut and locked with a latch 156. In alternate embodiments, the inside face of door 154 can be provided with pieces of steel 188, 190 which mate with magnets 192, 194 carried by flange 32. Door 154 can be provided around small pins (not shown) which project from adjacent the bottom edge 155 of door 154 in a direction parallel to edge 155. The pins are received within small pin receiving openings in box 102.

Motor 134 is energized to move belt 132, rotate drive wheel 130 and in turn rotate plate 126 with axle 128. Ice is advanced along slides 82 in the direction of cutter 122 by engaging the pin carried by members 98 with a ratchet 96 on arm 94. Downward force is applied to handle 100 to create a torque which pushes the pin toward the block of ice, thereby advancing plate 88 and ice 86 toward cutter 122. As the ice moves, it melts between adjacent slides 82 to engage the block of ice and help stabilize it against vibrational movement.

Handle 66 is rotated to advance rod 68 through collar 70 and thereby depress pressure plate 42 against the top of ice 86 by moving it downwardly about hinge 44. As block of ice 86 advances towards cutter 122, the top of it engages grating members 72. Since grating members are inclined in the direction of 122, they do not prevent sliding movement of block of ice 86 towards the cutter. They do, however, dig into the ice to prevent its movement away from the cutter in an area of the pressure plate adjacent the cutter. This mechanism enables the ice to be supported against vibrational movement at the point where it needs it the most.

As the leading face of ice 86 engages cutter 126, blades 138 shave ice off of it. The blades are curved so that the shaved ice enters the interior of housing 124. It is then moved under the influence of fan 140 through chute 142 and into exterior chute 144 whence it is placed in a waiting receptacle.

A more detailed understanding of the present invention can be obtained by reference to the co-pending application which is incorporated by reference.

I claim:

1. A device for producing ice cutings, comprising:

an inner box comprised of a flat rectangular base held in spaced relationship to a rectangular top by an upright rear wall, the inner box having first and second open opposing ends adjacent the rear wall, and a front wall which is partially open and defines an ice receiving opening having an upper edge and a lower edge;

an L-shaped flange projecting outwardly from and upwardly over the upper edge of the ice receiving opening;

an L-shaped flange projecting outwardly from and downwardly below the lower edge of the ice receiving opening;

an inner plate configured to close the first open end of the inner box, the inner plate being comprised of a flat member with flanges perpendicular to the flat member, the perpendicular flanges fitting flushly against adjacent walls of the inner box, the flat member defining a slot;

a pressure mechanism hingedly attached to the inner plate, the pressure mechanism comprising an elongated pressure plate attached to the inner plate with a vertical hinge having an axis, said hinge being adjacent a top edge of the inner plate, means for moving the pressure plate around the axis of the vertical hinge, and a plurality of grating members depending downwardly from a bottom face of the pressure plate and being inclined toward a cutter which is mounted adjacently to the second open end, the grating members being arranged in a plurality of parallel rows across at least a part of the pressure plate, the pressure plate being further provided with downwardly sloping flanges along opposing longitudinal edges of the pressure plate for retaining a block of ice beneath the pressure plate while permitting the block of ice to slide toward said cutter;

a plurality of continuous ice slides on the flat base of the inner box, each ice slide having an upwardly extending tip, the ice slides being substantially perpendicular to said inner plate;

a square pusher plate in parallel relationship to said inner plate, a bottom edge of the pusher plate being provided with a plurality of bearings which fit in sliding relationship between adjacent ice slides to guide the pusher plate towards the second end, the bearings having a height greater than that of the ice slides to hold the bottom edge of the pusher plate in spaced relationship to the ice slides;

a pusher arm attached to the pusher plate and extending through the slot in the inner plate;

an outer box held in spaced relationship around the inner box by first and second spacer members, the first spacer member being comprised of a plate defining an opening and having a first set of flanges which extend from a first face and fit in contiguous relationship with the inner box, and a second set of flanges which extend from a second face and fit in contiguous relationship with an interior of the outer box, the second spacer member being comprised of a plate defining an opening and having a first set of flanges which extend from a first face and fit in contiguous relationship with the inner box, and a second set of flanges which extend from a second face and fit in contiguous relationship with an interior of the outer box, the outer box also being held in spaced relationship to the inner box by the L-shaped flanges projecting outwardly from the top and bottom edges of the ice receiving opening; and a cutter disposed adjacently to the second end for cutting the ice as the pusher plate advances the ice into the cutter.

* * * * *